US010025211B2

(12) United States Patent
Hioki

(10) Patent No.: US 10,025,211 B2
(45) Date of Patent: Jul. 17, 2018

(54) ELECTROSTATIC LATENT IMAGE DEVELOPING TONER

(71) Applicant: KYOCERA Document Solutions Inc., Osaka (JP)

(72) Inventor: Jun Hioki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/554,223

(22) PCT Filed: Sep. 28, 2016

(86) PCT No.: PCT/JP2016/078650
§ 371 (c)(1),
(2) Date: Aug. 29, 2017

(87) PCT Pub. No.: WO2017/057474
PCT Pub. Date: Apr. 6, 2017

(65) Prior Publication Data

US 2018/0052404 A1 Feb. 22, 2018

(30) Foreign Application Priority Data

Oct. 1, 2015 (JP) ..... 2015-196018

(51) Int. Cl.
*G03G 9/08* (2006.01)
*G03G 9/093* (2006.01)
*G03G 9/087* (2006.01)

(52) U.S. Cl.
CPC ..... *G03G 9/0825* (2013.01); *G03G 9/0819* (2013.01); *G03G 9/08711* (2013.01); *G03G 9/08755* (2013.01); *G03G 9/09321* (2013.01); *G03G 9/09371* (2013.01); *G03G 9/09392* (2013.01)

(58) Field of Classification Search
CPC ..... G03G 9/0825; G03G 9/09321; G03G 9/09371; G03G 9/08711; G03G 9/09392; G03G 9/0819; G03G 9/08755
See application file for complete search history.

(56) References Cited

U.S. PATENT DOCUMENTS

2005/0271964 A1 12/2005 Etou et al.
2015/0004540 A1* 1/2015 Ozawa ..... G03G 9/0825 430/109.3

FOREIGN PATENT DOCUMENTS

JP 2004138985 A 5/2004
JP 2008089909 A 4/2008

* cited by examiner

*Primary Examiner* — Thorl Chea
(74) *Attorney, Agent, or Firm* — Studebaker & Brackett PC

(57) ABSTRACT

An electrostatic latent image developing toner includes toner particles each including a toner core and a shell layer disposed over a surface of the toner core. The shell layer includes a plurality of first domains (R1) and a second domain (R2) that is present at least among the first domains (R1). The first domains (R1) are each substantially formed from a first thermoplastic resin. The second domain (R2) is substantially formed from a second thermoplastic resin. The second thermoplastic resin is more hydrophobic than the first thermoplastic resin. The first thermoplastic resin includes at least one specific repeating unit having at least one group selected from the group consisting of a hydroxyl group, an amino group, and an amide group. A proportion of the at least one repeating unit among all repeating units included in the first thermoplastic resin is at least 0.5 mol % and no greater than 50 mol %.

10 Claims, 4 Drawing Sheets

ELECTROSTATIC LATENT IMAGE DEVELOPING TONER

TECHNICAL FIELD

The present invention relates to an electrostatic latent image developing toner, and particularly relates to a capsule toner.

BACKGROUND ART

Toner particles included in a capsule toner each include a core and a shell layer (capsule layer) disposed over a surface of the core. In a toner described in Patent Literature 1, a shell layer (thin film) contains a melamine resin. In a toner described in Patent Literature 2, a shell layer (shell region) contains a cross-linked polyester resin in an amount of 60% by mass or more.

CITATION LIST

Patent Literature

[Patent Literature 1]
Japanese Patent Application Laid-Open Publication No. 2004-138985
[Patent Literature 2]
Japanese Patent Application Laid-Open Publication No. 2008-89909

SUMMARY OF INVENTION

Technical Problem

The melamine resin is typically synthesized using formaldehyde. Therefore, when the toner described in Patent Literature 1 is heated, free formaldehyde tends to be generated from the toner. An increase in amount of free formaldehyde generated from the toner tends to cause an increase in load on environment and an increase in cost of disposal of waste liquid. It is thought that use of isocyanate as a raw material of the shell layer also causes problems similar to those caused by the use of formaldehyde.

By contrast, it is thought that in the toner described in Patent Literature 2, neither of formaldehyde and isocyanate is used as a raw material of the shell layer. However, the toner described in Patent Literature 2 has difficulty in achieving both high-temperature preservability and low-temperature fixability.

The present invention was made in view of the above-described problems, and it is an object of the present invention to provide an electrostatic latent image developing toner that is excellent in both high-temperature preservability and low-temperature fixability and that realizes reduction of free formaldehyde and free isocyanate generated from the toner.

Solution to Problem

An electrostatic latent image developing toner according to the present invention includes a plurality of toner particles each including a core and a shell layer disposed over a surface of the core. The shell layer includes a plurality of first domains and a second domain that is present at least among the plurality of first domains. The plurality of first domains are each substantially formed from a first thermoplastic resin. The second domain is substantially formed from a second thermoplastic resin. The second thermoplastic resin is more hydrophobic than the first thermoplastic resin. The first thermoplastic resin includes at least one specific repeating unit having at least one group selected from the group consisting of a hydroxyl group, an amino group, and an amide group. A proportion of the at least one specific repeating unit among all repeating units included in the first thermoplastic resin is at least 0.5 mol % and no greater than 50 mol %.

Advantageous Effects of Invention

According to the present invention, an electrostatic latent image developing toner that is excellent in both high-temperature preservability and low-temperature fixability and that realizes reduction of free formaldehyde and free isocyanate generated from the toner can be obtained.

DESCRIPTION OF EMBODIMENTS

Figure 1:
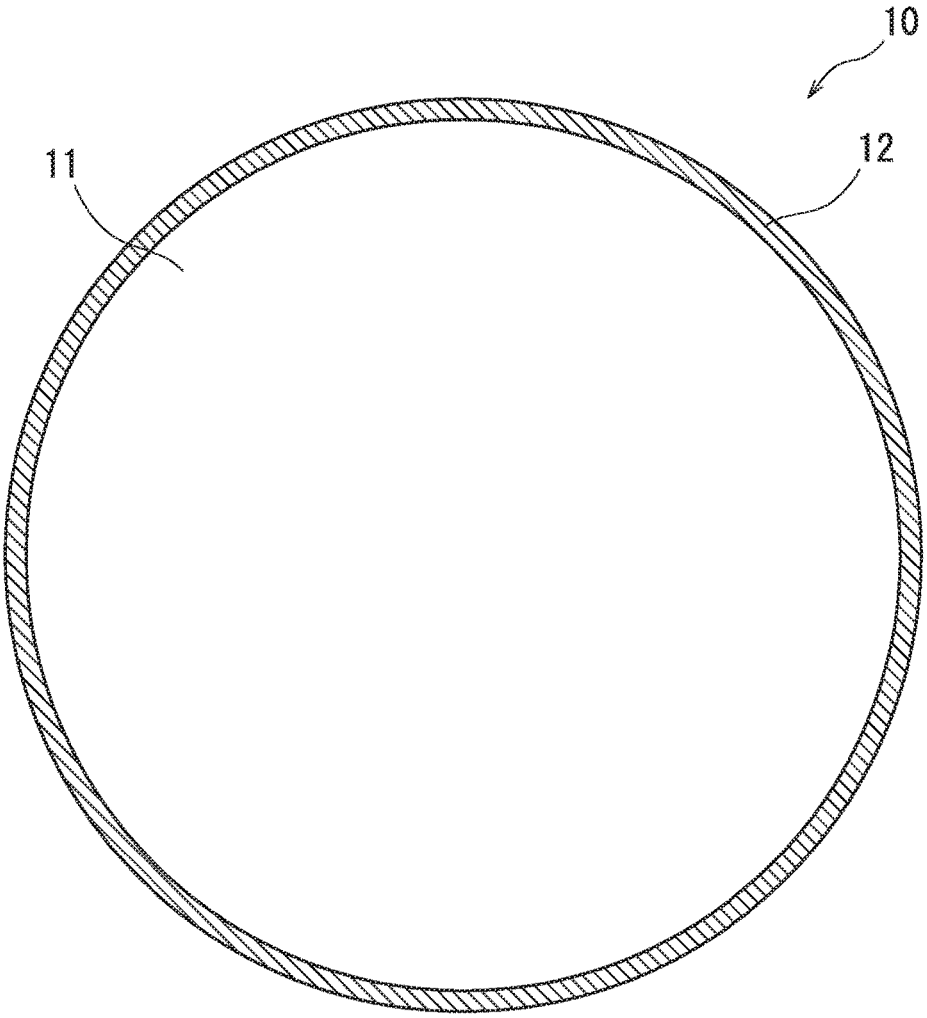
FIG. 1 is a diagram illustrating an example of cross-sectional structure of a toner particle (particularly, a toner mother particle) included in an electrostatic latent image developing toner according to an embodiment of the present invention.

The following explains an embodiment of the present invention in detail. Evaluation results (for example, values indicating a shape and physical properties) for a powder (specific examples include toner cores, toner mother particles, an external additive, and a toner) are each a number average of values measured for a suitable number of particles included in the powder, unless otherwise stated. A number average particle diameter of a powder is a value for equivalent circular diameters (diameters of circles having the same areas as projections of particles) of primary particles of the powder measured using a microscope, unless otherwise stated.

Chargeability refers to chargeability by triboelectric charging, unless otherwise stated. Strength of tendency to be positively charged (or strength of tendency to be negatively charged) by triboelectric charging can be known from a known triboelectric series.

In the following description, the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. Furthermore, the term "(meth)acryl" is used as a generic term for both acryl and methacryl.

A toner according to the present embodiment can be favorably used for example as a positively chargeable toner for development of an electrostatic latent image. The toner according to the present embodiment is a powder including a plurality of toner particles (particles each having features described below). The toner may be used as a one-component developer. Alternatively, the toner may be mixed with a carrier using a mixer (for example, a ball mill) to prepare a two-component developer. In order to form a high-quality image, a ferrite carrier (a powder of ferrite particles) is preferably used as the carrier. Also, in order to form a high-quality image for an extended period of time, magnetic carrier particles each including a carrier core and a resin layer covering the carrier core are preferably used. In order that carrier particles are magnetic, carrier cores thereof may be formed from a magnetic material (for example, a ferromagnetic material such as ferrite) or a resin in which magnetic particles are dispersed. Alternatively, magnetic particles may be dispersed in the resin layer covering the carrier core. In order to form a high-quality image, an amount of the toner in the two-component developer is preferably at least 5 parts by mass and no greater than 15 parts by mass relative to 100 parts by mass of the carrier, and more preferably at least 8 parts by mass and no greater than 12 parts by mass. Note that a positively chargeable toner included in a two-component developer is positively charged by friction with a carrier.

The toner particles included in the toner of the present embodiment each include a core (hereinafter referred to as a toner core) and a shell layer (capsule layer) disposed over a surface of the toner core. The shell layer covers the surface of the toner core. The shell layer may cover the entirety of the surface of the toner core or a part of the surface of the toner core. An external additive may be caused to adhere to a surface of the shell layer (or a surface region of the toner core that is not covered by the shell layer). Also, a plurality of shell layers may be layered on the surface of the toner core. Note that the external additive may be omitted if unnecessary. In the following description, a toner particle prior to adhesion of an external additive thereto will be referred to as a toner mother particle. Further, a material for forming the shell layer will be referred to as a shell material.

The toner according to the present embodiment can be used for image formation for example in an electrophotographic apparatus (image forming apparatus). The following describes an example of image forming methods performed by electrophotographic apparatuses.

Initially, an image forming section (a charger and a light exposure device) of an electrophotographic apparatus forms an electrostatic latent image on a photosensitive member (for example, on a surface of a photosensitive drum) based on image data. Subsequently, a developing device (specifically, a developing device loaded with a developer including a toner) of the electrophotographic apparatus supplies the toner to the photosensitive member to develop the electrostatic latent image formed on the photosensitive member. The toner is charged by friction with a carrier or a blade in the developing device before being supplied to the photosensitive member. For example, a positively chargeable toner is charged positively. In a development process, the toner (specifically, the charged toner) on a developing sleeve (for example, a surface of a development roller in the developing device) is supplied to the photosensitive member and adheres to the electrostatic latent image on the photosensitive member. As a result, a toner image is formed on the photosensitive member. Toner is supplied to the developing device from a toner container containing toner for replenishment use to make up for consumed toner.

In a subsequent transfer process, a transfer device of the electrophotographic apparatus transfers the toner image on the photosensitive member to an intermediate transfer member (for example, a transfer belt) and further transfers the toner image from the intermediate transfer member to a recording medium (for example, paper).

Thereafter, a fixing device (fixing method: nip fixing using a heating roller and a pressure roller) of the electrophotographic apparatus fixes the toner on the recording medium by applying heat and pressure to the toner. As a result, an image is formed on the recording medium. For example, a full-color image can be formed by superimposing toner images in four different colors: black, yellow, magenta, and cyan. Note that the transfer process may be a direct transfer process by which the toner image on the photosensitive member is transferred directly to the recording medium not via the intermediate transfer member. Also, a belt fixing method may be adopted as a fixing method.

The toner according to the present embodiment is an electrostatic latent image developing toner having features (hereinafter referred to as basic features) described below. Note that in the present description, a property of a substance is classified into three levels depending on affinity of the substance for water (hydrophilicity), and described as any of water-soluble, water-insoluble, and hydrophobic, which indicate stronger affinity for water (that is, weaker hydrophobicity) in stated order. A water-soluble substance dissolves in water. A water-insoluble substance does not dissolve in water but is dispersible in water by itself. A hydrophobic substance does not dissolve in water and does not disperse in water by itself. Whether or not a substance dissolves in water can be determined for example by: a method of adding the substance into water and determining whether or not the substance has dissolved based on light scattering; or a method of adding the substance into water and determining whether or not the substance has gelated by performing filtration after a predetermined period of time has elapsed from the addition of the substance into water. Strength of hydrophobicity (or strength of hydrophilicity) can also be determined by a contact angle of a water droplet (water wettability). A larger contact angle of a water droplet indicates stronger hydrophobicity.

(Basic Features of Toner)

The shell layer includes a plurality of first domains and a second domain that is present at least among the plurality of first domains. The plurality of first domains are each substantially formed from a first thermoplastic resin. The second domain is substantially formed from a second thermoplastic resin. The second thermoplastic resin is more hydrophobic than the first thermoplastic resin. The first thermoplastic resin includes at least one repeating unit (hereinafter referred to as a specific repeating unit) having at least one group selected from the group consisting of a hydroxyl group, an amino group, and an amide group. A proportion of the at least one specific repeating unit among all repeating units included in the first thermoplastic resin is at least 0.5 mol % and no greater than 50 mol %.

Formula (1) represents an example (a repeating unit derived from 4-hydroxybutyl acrylate) of repeating units having a hydroxyl group (—OH). Formula (2) represents an example (a repeating unit derived from 2-(dimethylamino) ethyl methacrylate) of repeating units having an amino group (—$NR_2$). Formula (3) represents an example (a repeating unit derived from N,N-dimethylacrylamide) of repeating units having an amide group (—CO—$NR_2$). Formula (4) represents an example (a repeating unit derived from butyl acrylate) of repeating units having none of the hydroxyl group, amino group, and amide group. In formulas (1) to (4), n represents, independently of one another, the number of repetition (the number of moles) of the repeating unit.

[Formula 1]

(1)

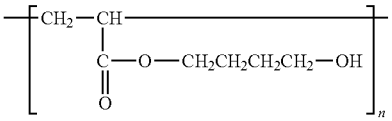

[Formula 2]

(2)

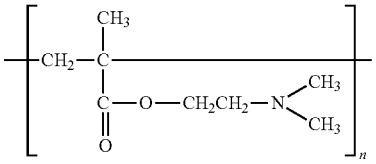

[Formula 3]

(3)

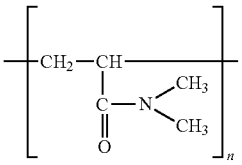

[Formula 4]

(4)

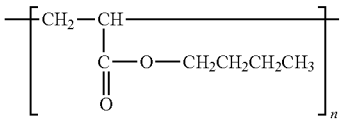

For example, in a configuration in which the first thermoplastic resin includes only the four repeating units represented by formulas (1) to (4), a proportion of specific repeating units is obtained by dividing a sum of respective numbers of moles of the three repeating units represented by formulas (1) to (3) by a sum of respective numbers of moles of all the repeating units (four repeating units). When the proportion is expressed as a percentage (mol %), the thus calculated value is multiplied by 100.

Figure 2:
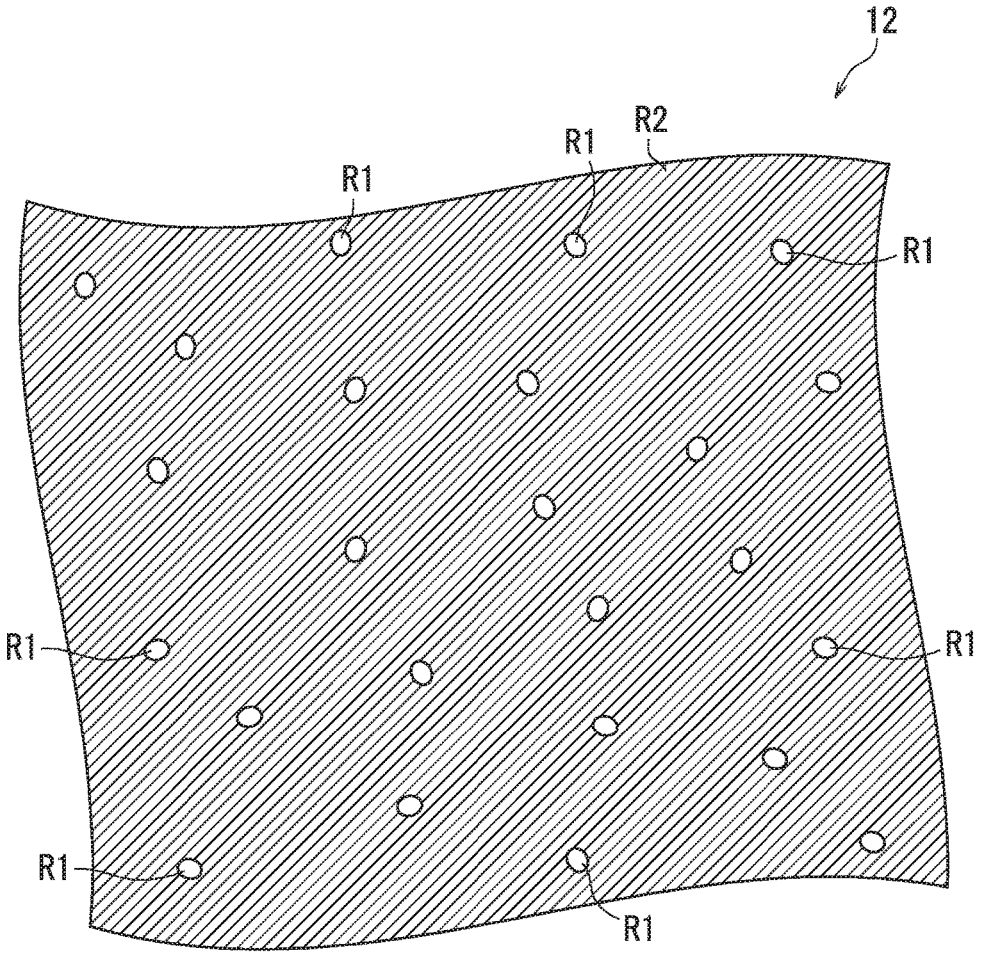
FIG. 2 is an enlarged view of a part of a surface of the toner mother particle illustrated in FIG. 1.
Figure 3A:
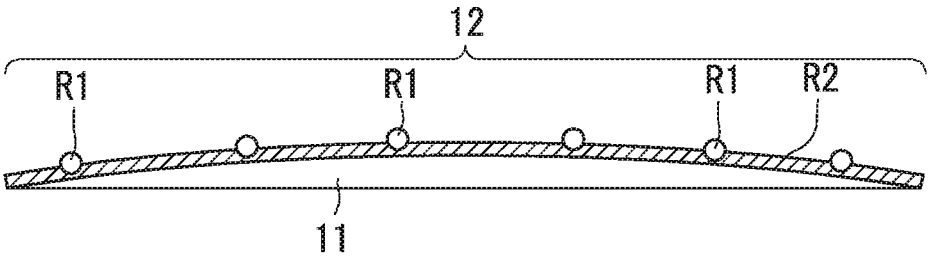
FIG. 3A is a diagram illustrating a toner mother particle including resin particles protruding from a surface of a resin film.
Figure 3B:
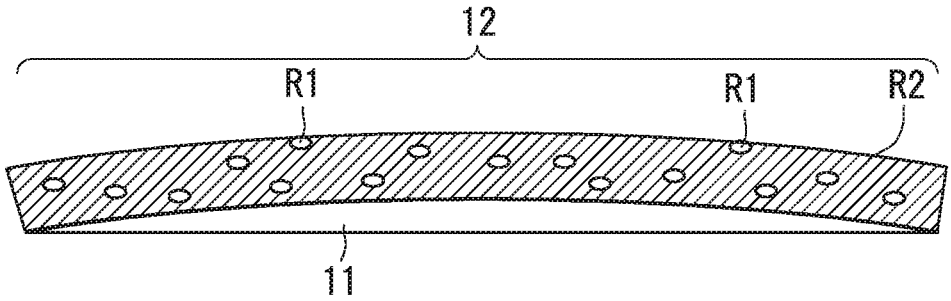
FIG. 3B is a diagram illustrating a toner mother particle including no resin particle protruding from a surface of a resin film.

The following describes with reference to FIGS. 1, 2, 3A, and 3B, an example of structure of a toner particle (specifically, toner mother particle) included in the toner according to the present embodiment. Note that FIG. 1 illustrates an example of cross-sectional structure of the toner particle (particularly, toner mother particle) included in the toner according to the present embodiment. FIG. 2 is an enlarged view of a surface of the toner mother particle illustrated in FIG. 1. FIGS. 3A and 3B are each an enlarged view of a boundary between a toner core 11 and a shell layer 12 illustrated in FIG. 1. In each of FIGS. 2, 3A, and 3B, a hatched region corresponds to a second domain R2.

A toner mother particle 10 illustrated in FIG. 1 includes a toner core 11 and a shell layer 12 disposed over a surface of the toner core 11. The shell layer 12 is substantially formed from resins. The shell layer 12 covers the surface of the toner core 11. The shell layer 12 may cover the entirety of the surface of the toner core 11 or a part of the surface of the toner core 11.

Further, as illustrated in FIG. 2, the shell layer 12 includes a plurality of first domains R1 and a second domain R2. The second domain R2 is present among the plurality of first domains R1. The plurality of first domains R1 each have a particle shape. The second domain R2 has a film shape. The number of the second domain R2 may be one or more than one. In the example illustrated in FIG. 2, at least one first domain R1 and at least a part of the second domain R2 are exposed at a surface of the shell layer 12. The first domains R1 are distributed over the surface of the shell layer 12. Further, the shell layer 12 has sea-and-island structure (sea: second domain R2, island: first domains R1) formed by the first domains R1 and the second domain R2. The second domain R2 is distributed like a sea and the plurality of first domains R1 are distributed like islands. The first domains R1 are each surrounded by the second domain R2.

The first domains R1 are particles substantially formed from the first thermoplastic resin. The first thermoplastic resin is preferably a water-insoluble thermoplastic resin having physical cross-linking structure formed by hydrogen bonding. The second domain R2 is a film substantially formed from the second thermoplastic resin. The second thermoplastic resin is more hydrophobic than the first thermoplastic resin. The second thermoplastic resin is preferably a hydrophobic thermoplastic resin that does not have physical cross-linking structure formed by hydrogen bonding. As illustrated in FIG. 3A, the first domains R1 may protrude from a surface of the second domain R2. Alternatively, as illustrated in FIG. 3B, the first domains R1 may be dispersed in the second domain R2. In both examples illustrated in FIGS. 3A and 3B, the plurality of first domains R1 are each in contact with the second domain R2. Further, the first domains R1 are separated from one another by the second domain R2.

A toner having the above-described basic features tends to be excellent in both high-temperature preservability and low-temperature fixability. The shell layer specified in the above-described basic features has structure in which the plurality of first domains are distinctly separated from the second domain. The first thermoplastic resin forming the first domains includes a specific repeating unit and therefore is capable of forming hydrogen bonds. The first thermoplastic resin tends to be physically cross-linked by hydrogen bonds. Therefore, the first domains tend to be more difficult to plastically deform than the second domain. When the toner having the above-described basic features is used for image formation, the shell layer can be easily fractured for example by applying pressure to the toner particles in a fixing process. This is presumably because the first domains are embedded into the toner core by external force. Further, the shell layer of the toner having the above-described basic features is difficult to fracture at normal temperature. This is presumably because the second domain present among the plurality of first domains has high strength at normal temperature with high stability. Further, the toner particles of the toner having the above-described basic features are difficult to agglomerate with one another even when the toner particles are heated and the second domain softens. This is presumably because the first domains function as spacers among the plurality of toner particles. The first domains having physical cross-linking structure are thought to be difficult to soften even when heated.

Further, it is thought that fluidity of the toner is improved as a result of the first domains functioning as spacers among the plurality of toner particles. In the toner having the above-described basic features, sufficient fluidity of the toner can be easily ensured even by reducing an amount of an external additive (or without using an external additive). Also, the plurality of first domains are prevented from being separated from a toner particle as a result of the second domain being present among the first domains.

In the toner having the above-described basic features, the first thermoplastic resin forming the first domains includes at least one specific repeating unit (repeating unit having at least one group selected from the group consisting of a hydroxyl group, an amino group, and an amide group) in an amount of at least 0.5 mol % and no greater than 50 mol %. Such a first thermoplastic resin can be synthesized without using formaldehyde and isocyanate. The specific repeating unit tends to be strongly hydrophilic. However, in a configuration in which a proportion of the at least one specific repeating unit is no greater than 50 mol %, the resin can be easily made hydrophobic to an extent that the resin does not dissolve in water by selection of other repeating units. Also, in a configuration in which a proportion of the at least one specific repeating unit is at least 0.5 mol %, sufficient physical cross-linking structure can be easily achieved in the first domains.

Also, the above-described basic features are effective to improve chargeability of the toner. The first thermoplastic resin forming the first domains has stronger hydrophilicity (affinity for water) than the second thermoplastic resin forming the second domain. In the toner having the above-described basic features, adsorption of moisture to surfaces of the toner particles is unlikely to occur since each first domain is covered by the second domain or the first domains are separated from one another by the second domain. Therefore, the toner having the above-described basic features tends to be excellent in charge stability (specifically, not prone to charge decay).

In order to improve charge stability of the toner, it is particularly preferable that the plurality of first domains each have a particle shape and the second domain has a film shape. Specifically, it is particularly preferable that the shell layer has sea-and-island structure (sea: second domain, island: first domains) formed by the first domains and the second domain (see for example FIGS. 2, 3A, and 3B).

In a configuration in which the shell layer of the above-described basic features has the sea-and-island structure (sea: second domain, island: first domains) formed by the first domains and the second domain, it is preferable that the first domains have a number average primary particle diameter of at least 20 nm and no greater than 70 nm and the second domain has a thickness of at least 10 nm and no greater than 60 nm. The number average primary particle diameter is measured according to a method used in examples described further below or an alternative method thereof. The thickness of the second domain can be measured through analysis of a TEM image of a cross section of a toner particle using a commercially available image analysis software (for example, "WinROOF" produced by Mitani Corporation). In a situation in which the second domain of a toner particle does not have a uniform thickness, thicknesses of the second domain are measured at four positions equally spaced apart from each other (specifically, four positions at which the second domain intersects with two orthogonal straight lines intersecting with each other at substantially the center of the cross section of the toner particle), and an arithmetic mean of the thus measured four values is determined to be an evaluation value (the thickness of the second domain) of the toner particle. In a situation in which a boundary between the toner core and the second domain in the TEM image is unclear, the boundary between the toner core and the second domain can be clarified by mapping characteristic elements contained in the second domain in the TEM image using a combination of TEM and electron energy loss spectroscopy (EELS).

In a configuration in which the shell layer of the above-described basic features has the sea-and-island structure (sea: second domain, island: first domains) formed by the first domains and the second domain, the first thermoplastic resin forming the first domains preferably has a higher glass transition point (Tg) than the second thermoplastic resin forming the second domain, and the glass transition point (Tg) of the first thermoplastic resin is preferably at least 75° C. and no greater than 120° C. Tg is measured according to a method used in the examples described further below or an alternative method thereof.

Further, the thermoplastic resins (first thermoplastic resin and second thermoplastic resin) specified in the above-described basic features can be easily synthesized without using formaldehyde.

The toner according to the present embodiment includes a plurality of toner particles (hereinafter referred to as toner particles of the present embodiment) specified by the above-described basic features. The toner including the plurality of toner particles of the present embodiment is thought to generate small amounts of free formaldehyde and free isocyanate and be excellent in both high-temperature preservability and low-temperature fixability (see Tables 1 to 3 shown further below). In order to achieve both high-temperature preservability and low-temperature fixability of the toner, a proportion of the toner particles of the present embodiment included in the toner is preferably at least 80% by number, more preferably at least 90% by number, and further preferably 100% by number.

In order to reduce amounts of free formaldehyde and free isocyanate generated from the toner, a proportion of a thermosetting resin (hereinafter referred to as a specific thermosetting resin) formed by polymerization reaction of formaldehyde or isocyanate among all resins forming the shell layer is preferably not greater than 5% by mass, more preferably not greater than 1%, and further preferably 0% (i.e., the shell layer does not contain the specific thermosetting resin at all). Formaldehyde or isocyanate is used in synthesis of the specific thermosetting resin (specific examples include melamine resins, urea resins, glyoxal resins, and urethane resins). Therefore, it is thought that the specific thermosetting resin tends to generate free formaldehyde or free isocyanate.

In order to achieve both high-temperature preservability and low-temperature fixability of the toner, the shell layer preferably covers at least 50% and no greater than 99% of a surface area of the toner core, and more preferably at least 70% and no greater than 95%.

In order to achieve both high-temperature preservability and low-temperature fixability of the toner, the toner preferably has a volume median diameter ($D_{50}$) of at least 1 μm and no greater than 10 μm. The volume median diameter ($D_{50}$) is measured according to a method used in the example described further below or an alternative method thereof.

The following describes the toner core (a binder resin and internal additives), the shell layer, and the external additive in order. Non-essential components (for example, the internal additives and external additive) may be omitted depending on intended use of the toner.

<Preferable Thermoplastic Resins>

Examples of thermoplastic resins that can be preferably used for forming the toner particles (particularly, the toner cores and the shell layers) include styrene-based resins, acrylic acid-based resins (specific examples include acrylic acid ester polymers and methacrylic acid ester polymers), olefin-based resins (specific examples include polyethylene resins and polypropylene resins), vinyl chloride resins, polyvinyl alcohols, vinyl ether resins, N-vinyl resins, polyester resins, polyamide resins, and urethane resins. Also, copolymers of the above-listed resins, that is, copolymers (specific examples include styrene-acrylic acid-based resins and styrene-butadiene-based resins) obtained by introducing a repeating unit into the above-listed resins may be preferably used as thermoplastic resins forming the toner particles.

A styrene-acrylic acid-based resin is a copolymer of at least one styrene-based monomer and at least one acrylic acid-based monomer. Examples of styrene-based monomers and acrylic acid-based monomers that can be preferably used for synthesis of a styrene-acrylic acid-based resin are listed below. As a result of using an acrylic acid-based monomer having a carboxyl group, the carboxyl group can be introduced into the styrene-acrylic acid-based resin. As a result of using a monomer having a hydroxyl group (specific examples include p-hydroxystyrene, m-hydroxystyrene, and (meth)acrylic acid hydroxyalkyl ester), the hydroxyl group can be introduced into the styrene-acrylic acid-based resin. An acid value of the styrene-acrylic acid-based resin being obtained can be adjusted by adjusting an amount of use of the acrylic acid-based monomer. A hydroxyl value of the styrene-acrylic acid-based resin being obtained can be adjusted by adjusting an amount of use of the monomer having the hydroxyl group.

Preferable examples of styrene-based monomers include styrene, α-methylstyrene, p-hydroxy styrene, m-hydroxy styrene, vinyltoluene, α-chlorostyrene, o-chlorostyrene, m-chlorostyrene, p-chlorostyrene, and p-ethylstyrene.

Preferable examples of acrylic acid-based monomers include (meth)acrylic acid, (meth)acrylic acid alkyl esters, (meth)acrylic acid hydroxyalkyl esters, and (meth)acrylamide. Preferable examples of (meth)acrylic acid alkyl esters include methyl (meth)acrylate, ethyl (meth)acrylate, n-propyl (meth)acrylate, iso-propyl (meth)acrylate, n-butyl (meth)acrylate, iso-butyl (meth)acrylate, and 2-ethylhexyl (meth)acrylate. Preferable examples of (meth)acrylic acid hydroxyalkyl esters include 2-hydroxyethyl (meth)acrylate, 3-hydroxypropyl (meth)acrylate, 2-hydroxypropyl (meth) acrylate, and 4-hydroxybutyl (meth)acrylate.

A polyester resin can be obtained through condensation polymerization of at least one polyhydric alcohol and at least one polybasic carboxylic acid. Examples of alcohols that can be preferably used for synthesis of a polyester resin include dihydric alcohols (specific examples include diols and bisphenols) and tri- or higher-hydric alcohols listed below. Examples of carboxylic acids that can be preferably used for synthesis of a polyester resin include dibasic carboxylic acids and tri- or higher-basic carboxylic acids listed below. An acid value and a hydroxyl value of a polyester resin can be adjusted by changing amounts of use of an alcohol and a carboxylic acid in synthesis of the polyester resin. The acid value and the hydroxyl value of the polyester resin tend to decrease with an increase of a molecular weight of the polyester resin.

Preferable examples of diols include ethylene glycol, diethylene glycol, triethylene glycol, 1,2-propanediol, 1,3-propanediol, 1,4-butanediol, neopentyl glycol, 2-butene-1, 4-diol, 1,5-pentanediol, 1,6-hexanediol, 1,4-cyclohexanedimethanol, dipropylene glycol, polyethylene glycol, polypropylene glycol, and polytetramethylene glycol.

Preferable examples of bisphenols include bisphenol A, hydrogenated bisphenol A, bisphenol A ethylene oxide adducts, and bisphenol A propylene oxide adducts.

Preferable examples of tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Preferable examples of dibasic carboxylic acids include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (specific examples include n-butylsuccinic acid, isobutylsuccinic acid, n-octylsuccinic acid, n-dodecylsuccinic acid, and isododecylsuccinic acid), and alkenylsuccinic acids (specific examples include n-butenylsuccinic acid, isobutenylsuccinic acid, n-octenylsuccinic acid, n-dodecenylsuccinic acid, and isododecenylsuccinic acid).

Preferable examples of tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

Note that an ester-forming derivative (specific examples include an acid halide, an acid anhydride, and a lower alkyl ester) of any of the di-, tri-, or higher-basic carboxylic acids listed above may be used. Here, "lower alkyl" means an alkyl group having a carbon number of at least 1 and no greater than 6.

[Toner Core]

The toner core contains a binder resin. Also, the toner core may contain internal additives (for example, a colorant, a releasing agent, a charge control agent, and a magnetic powder).

(Binder Resin)

The binder resin is typically a main component (for example, at least 85% by mass) of the toner core. Properties of the binder resin are therefore thought to have a great influence on properties of the toner core as a whole. For example, in a configuration in which the binder resin has an ester group, a hydroxyl group, an ether group, an acid group, or a methyl group, the toner core has strong tendency to be anionic. In a configuration in which the binder resin has an amino group or an amide group, the toner core has strong tendency to be cationic. In order that the binder resin is strongly anionic, a hydroxyl value (measured according to JIS (Japanese Industrial Standard) K0070-1992) and an acid value (measured according to JIS (Japanese Industrial Standard) K0070-1992) of the binder resin are each preferably at least 10 mgKOH/g, and more preferably at least 20 mgKOH/g.

Resins having at least one group selected from the group consisting of an ester group, a hydroxyl group, an ether group, an acid group, and a methyl group are preferable as the binder resin, and resins having a hydroxyl group and/or a carboxyl group are more preferable as the binder resin. A binder resin having such a functional group tends to strongly bond with a shell material. A toner core containing such a binder resin tends to firmly bond with the shell layer. Further, resins that have a functional group including active hydrogen in its molecule are also preferable as the binder resin.

In order to improve fixability of the toner in high speed fixing, the binder resin preferably has a glass transition point (Tg) of at least 20° C. and no greater than 55° C. Also, in order to improve fixability of the toner in high speed fixing, the binder resin preferably has a softening point (Tm) of no greater than 100° C. Tg and Tm are measured according to respective methods used in the examples described further below or alternative methods thereof. Tg and/or Tm of a resin can be adjusted by changing a component (monomer) of the resin or an amount of the component. Tg and/or Tm of the binder resin can also be adjusted by using a plurality of resins in combination.

The binder resin of the toner core is preferably a thermoplastic resin (specific examples include "Preferable Thermoplastic Resins" listed above). In order to improve dispersibility of a colorant in the toner core, chargeability of the toner, and fixability of the toner to a recording medium, it is particularly preferable to use a styrene-acrylic acid-based resin or a polyester resin as the binder resin.

In a configuration in which a styrene-acrylic acid-based resin is used as the binder resin of the toner core, the styrene-acrylic acid-based resin preferably has a number average molecular weight (Mn) of at least 2,000 and no greater than 3,000 in order to improve strength of the toner core and fixability of the toner. The styrene-acrylic acid-based resin preferably has molecular weight distribution (ratio Mw/Mn of a mass average molecular weight (Mw) to the number average molecular weight (Mn)) of at least 10 and no greater than 20. Mn and Mw of the styrene-acrylic acid-based resin can be measured by gel permeation chromatography.

In a configuration in which a polyester resin is used as the binder resin of the toner core, the polyester resin preferably has a number average molecular weight (Mn) of at least 1,000 and no greater than 2,000 in order to improve strength of the toner core and fixability of the toner. The polyester resin preferably has molecular weight distribution (ratio Mw/Mn of a mass average molecular weight (Mw) to the number average molecular weight (Mn)) of at least 9 and no greater than 21. Mn and Mw of the polyester resin can be measured by gel permeation chromatography.

(Colorant)

The toner core may contain a colorant. A known pigment or dye that matches the color of the toner can be used as the colorant. In order to form a high-quality image using the toner, an amount of the colorant is preferably at least 1 part by mass and no greater than 20 parts by mass relative to 100 parts by mass of the binder resin, and more preferably at least 3 parts by mass and no greater than 10 parts by mass.

The toner core may contain a black colorant. Carbon black is an example of the black colorant. Alternatively, a colorant that is adjusted to a black color using a yellow colorant, a magenta colorant, and a cyan colorant may be used as the black colorant.

The toner core may contain a non-black colorant such as a yellow colorant, a magenta colorant, or a cyan colorant.

One or more compounds selected from the group consisting of condensed azo compounds, isoindolinone compounds, anthraquinone compounds, azo metal complexes, methine compounds, and arylamide compounds can for example be used as the yellow colorant. Examples of yellow colorants that can be preferably used include C. I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C.I. Vat Yellow.

One or more compounds selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds can for example be used as the magenta colorant. Examples of magenta colorants that can be preferably used include C. I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

One or more compounds selected from the group consisting of copper phthalocyanine compounds, anthraquinone compounds, and basic dye lake compounds can for example be used as the cyan colorant. Examples of cyan colorants that can be preferably used include C. I. Pigment Blue (1, 7, 15, 15:1, 15:2, 15:3, 15:4, 60, 62, and 66), Phthalocyanine Blue, C.I. Vat Blue, and C.I. Acid Blue.

(Releasing Agent)

The toner core may contain a releasing agent. The releasing agent is used for example in order to improve fixability of the toner or resistance of the toner to being offset. In order to improve anionic strength of the toner core, the toner core is preferably prepared using an anionic wax. In order to improve fixability of the toner or resistance of the toner to being offset, an amount of the releasing agent is preferably at least 1 part by mass and no greater than 30 parts by mass relative to 100 parts by mass of the binder resin, and more preferably at least 5 parts by mass and no greater than 20 parts by mass.

Examples of releasing agents that can be preferably used include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as a main component such as montanic acid ester wax and castor wax; and waxes in which a part or all of a fatty acid ester has been deoxidized such as deoxidized carnauba wax. A releasing agent may be used alone, or two or more releasing agents may be used in combination.

A compatibilizer may be added to the toner core in order to improve compatibility between the binder resin and the releasing agent.

(Charge Control Agent)

The toner core may contain a charge control agent. The charge control agent is used for example in order to improve charge stability or a charge rise characteristic of the toner. The charge rise characteristic of the toner is an indicator as to whether or not the toner can be charged to a specific charge level in a short period of time.

Anionic strength of the toner core can be increased by including a negatively chargeable charge control agent (specific examples include organic metal complexes and chelate compounds) in the toner core. Cationic strength of the toner core can be increased by including a positively chargeable charge control agent (specific examples include pyridine, nigrosine, and quaternary ammonium salts) in the toner core. However, the toner core need not contain a charge control agent so long as sufficient chargeability of the toner can be ensured.

(Magnetic Powder)

The toner core may contain a magnetic powder. Examples of materials of the magnetic powder that can be preferably used include ferromagnetic metals (specific examples include iron, cobalt, nickel, and an alloy containing one or more of these metals), ferromagnetic metal oxides (specific examples include ferrite, magnetite, and chromium dioxide), and materials subjected to ferromagnetization (specific examples include carbon materials to which ferromagnetism is imparted through thermal treatment). A magnetic powder may be used alone, or two or more magnetic powders may be used in combination.

The magnetic powder is preferably subjected to surface treatment in order to inhibit elution of metal ions (for example, iron ions) from the magnetic powder. In a situation in which the shell layer is formed on the surface of each toner core under acidic conditions, elution of metal ions to the surfaces of the toner cores tends to cause adhesion of the toner cores to one another. It is expected that adhesion of the toner cores to one another can be inhibited by inhibiting elution of metal ions from the magnetic powder.

[Shell Layer]

The toner according to the present embodiment has the above-described basic features. The shell layer contains the first thermoplastic resin forming the first domains and the second thermoplastic resin forming the second domain. For example, the second thermoplastic resin is preferably any of the "Preferable Thermoplastic Resins" listed above. In order to form homogeneous shell layer, it is preferable that the first thermoplastic resin forming the first domains and the second thermoplastic resin forming the second domain each include at least one repeating unit derived from an acrylic acid-based monomer. A compound having a vinyl group ($CH_2$=CH—) or a substituted vinyl group in which hydrogen is replaced is normally included as a repeating unit in a polymer (resin) as a result of addition polymerization through carbon-to-carbon double bonds "C=C".

In order to achieve both high-temperature preservability and low-temperature fixability of the toner, the first thermoplastic resin forming the first domains preferably includes at least one repeating unit selected from the group consisting of: a repeating unit derived from a (meth)acrylic acid hydroxyalkyl ester (specific examples include 4-hydroxybutyl acrylate); a repeating unit derived from a (meth)acrylic acid alkylaminoalkyl ester (specific examples include 2-(dimethylamino)ethyl methacrylate); and a repeating unit derived from an alkylacrylamide (specific examples include N,N-dimethylacrylamide). In order to prevent separation of the shell layer from the toner core, it is particularly preferable that the first thermoplastic resin forming the first domains further includes at least one repeating unit derived from an acrylic acid-based monomer, in addition to the specific repeating unit. The first thermoplastic resin is particularly preferably a polymer of at least two acrylic acid-based monomers (for example, three acrylic acid-based monomers: an acrylic acid alkyl ester, a methacrylic acid alkyl ester, and an alkylacrylamide) including at least one acrylic acid-based monomer selected from the group consisting of a (meth)acrylic acid hydroxyalkyl ester, a (meth) acrylic acid alkylaminoalkyl ester, and an alkylacrylamide.

In order to prevent separation of the shell layer from the toner core, the second thermoplastic resin forming the second domain preferably includes at least one repeating unit derived from an acrylic acid-based monomer. In order to improve charge stability of the toner, the second thermoplastic resin forming the second domain is particularly preferably a copolymer of at least one styrene-based monomer (for example, styrene) and at least one acrylic acid-based monomer (for example, an acrylic acid ester). A styrene-acrylic acid-based resin tends to be more hydrophobic and more readily positively chargeable than a polyester resin.

[External Additive]

An external additive may be caused to adhere to a surface of each toner mother particle. The external additive is used for example in order to improve fluidity or handleability of the toner. In order to improve fluidity or handleability of the toner, an amount of the external additive is preferably at least 0.5 parts by mass and no greater than 10 parts by mass relative to 100 parts by mass of the toner mother particles. Also, in order to improve fluidity or handleability of the toner, the external additive preferably has a particle diameter of at least 0.01 μm and no greater than 1.0 μm.

Silica particles or particles of metal oxides (specific examples include alumina, titanium oxide, magnesium oxide, zinc oxide, strontium titanate, and barium titanate) can be preferably used as the external additive. An external additive may be used alone, or two or more external additives may be used in combination.

[Method for Producing Toner]

The following describes an example of methods for producing the toner having the above-described basic features. Initially, toner cores are prepared. Subsequently, the toner cores and shell materials are added into a liquid. In order to form a homogeneous shell layer, the shell materials are preferably dissolved or dispersed in the liquid for example by stirring the liquid containing the shell materials. Then, the shell materials are caused to react in the liquid to form the shell layer (hardened resin) on a surface of each toner core. In order to inhibit dissolution or elution of toner core components (particularly, the binder resin and releasing agent) during formation of the shell layer, the shell layer is preferably formed in an aqueous medium. The aqueous medium is a medium of which a main component is water (specific examples include pure water and a liquid mixture of water and a polar medium). The aqueous medium may function as a solvent. A solute may be dissolved in the aqueous medium. The aqueous medium may function as a dispersion medium. A dispersoid may be dispersed in the aqueous medium. Examples of polar mediums that can be used in the aqueous medium include alcohols (specific examples include methanol and ethanol).

The following further describes a more specific example of the method for producing the toner according to the present embodiment.

(Preparation of Toner Cores)

In order to obtain favourable toner cores easily, the toner cores are prepared preferably by an aggregation method or a pulverization method, and more preferably by the pulverization method.

The following describes an example of the pulverization method. Initially, the binder resin and an internal additive (for example, at least one of the colorant, the releasing agent, the charge control agent, and the magnetic powder) are mixed together. Then, the resultant mixture is melt-kneaded. Then, the resultant melt-kneaded product is pulverized, and the pulverized product is classified. As a result, toner cores having a desired particle diameter are obtained.

The following describes an example of the aggregation method. Initially, the binder resin, the releasing agent, and the colorant each in the form of particulates are caused to aggregate in an aqueous medium to form particles having a desired particle diameter. Through the above, aggregated particles containing components of the binder resin, the releasing agent, and the colorant are formed. Subsequently, the resultant aggregated particles are heated to cause coalescence of the components contained in the aggregated particles. As a result, a dispersion of toner cores is obtained. Thereafter, unnecessary substances (a surfactant and the like) are removed from the dispersion of the toner cores, whereby the toner cores are obtained.

(Formation of Shell Layer)

As the above-described aqueous medium into which the toner cores and shell materials are added, for example ion exchanged water is prepared. Subsequently, pH of the aqueous medium is adjusted to a specific pH (for example, approximately 7). Subsequently, the toner cores, a suspension of the first thermoplastic resin (for example, a liquid containing a plurality of particles of a water-insoluble thermoplastic resin having physical cross-linking structure formed by hydrogen bonding) and a suspension of the second thermoplastic resin (for example, a liquid containing a plurality of particles of a hydrophobic thermoplastic resin that does not have physical cross-linking structure formed by hydrogen bonding) are added to the aqueous medium (for example, neutral ion exchanged water) having the adjusted pH. Further, materials for synthesizing a thermosetting resin may be added to the aqueous medium as necessary.

The toner cores and the shell materials described above may be added to the aqueous medium at room temperature or the aqueous medium at a specific temperature controlled (kept warm) in advance. Appropriate amounts of the shell materials can be calculated based on a specific surface area of the toner cores. Further, a polymerization accelerator may be added to the aqueous medium in addition to the above-described shell material and the like.

Figure 4:
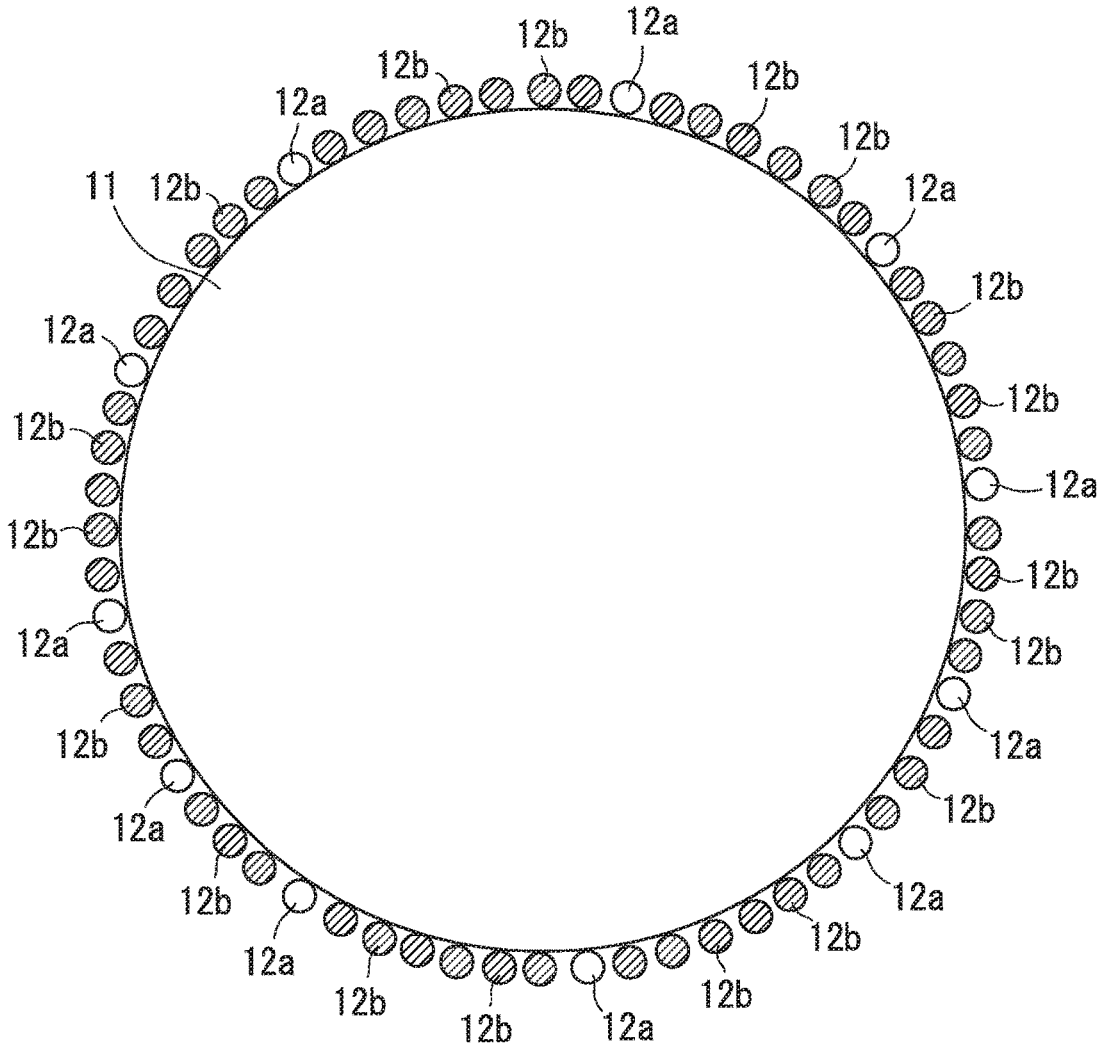
FIG. 4 is a diagram for explaining a production method of the electrostatic latent image developing toner according to the embodiment of the present invention.

As illustrated in FIG. 4, first thermoplastic resin particles 12*a* and second thermoplastic resin particles 12*b* adhere to the surface of the toner core 11 in a liquid. In order that the shell materials uniformly adhere to the surface of each toner core, it is preferable to achieve a high degree of dispersion of the toner cores in the liquid containing the shell materials. In order to achieve a high degree of dispersion of the toner cores in the liquid, a surfactant may be added to the liquid or the liquid may be stirred using a powerful stirrer (for example, "Hivis Disper Mix" produced by PRIMIX Corporation). In a situation in which the toner cores are anionic, agglomeration of the toner cores can be inhibited by using an anionic surfactant having the same polarity. Examples of surfactants that can be used include sulfate ester salts, sulfonic acid salts, phosphate ester salts, and soaps.

Subsequently, a temperature of the liquid containing the above-described shell materials and the like is increased up to a predetermined holding temperature (for example, at least 45° C. and no greater than 85° C.) at a predetermined rate (for example, at least 0.1° C./minute and no greater than 3° C./minute) while the liquid is stirred. The temperature of the liquid is maintained at the holding temperature for a predetermined period of time (for example, at least 30 minutes and no longer than 4 hours) while the liquid is stirred. By adjusting the holding temperature, Tg of the first thermoplastic resin, and Tg of the second thermoplastic resin, the first thermoplastic resin particles and/or the second thermoplastic resin particles can be maintained as particles or melted (or deformed) to harden into a film shape. Specifically, when the liquid is maintained at a temperature of "Tg of resin particles—5° C." or higher for a sufficiently long period of time, the resin particles tend to be melted (deformed) into a film. For example, resin particles having Tg of 50° C. can be formed into a film by maintaining the temperature of the liquid at 45° C. or higher. Also, by maintaining the temperature of the liquid sufficiently higher than Tg of the resin particles, the resin particles can be completely melted to form a film with no granular appearance. For example, when only the second thermoplastic resin particles among the first and second thermoplastic resin particles are melted, the molten second thermoplastic resin particles are thought to gather to form a film. By contrast, when the first thermoplastic resin particles are not melted or deformed, the first thermoplastic resin particles are thought to remain as particles. As described above, a shell layer including the plurality of first thermoplastic resin particles and a film of the second thermoplastic resin present among the first thermoplastic resin particles can be formed on the surface of each toner core. Alternatively, a shell layer including the plurality of first thermoplastic resin particles and the plurality of second thermoplastic resin particles can be formed on the surface of each toner core without forming neither of the first thermoplastic resin particles and the second thermoplastic resin particles into a film. In such a shell layer, the second thermoplastic resin particles are present among the first thermoplastic resin particles. Alternatively, both of the first thermoplastic resin particles and the second thermoplastic resin particles may be formed into a film. The first thermoplastic resin particles including the specific repeating unit are thought not to significantly deform until the temperature exceeds a dissociation temperature of hydrogen bonds formed in the first thermoplastic resin.

Roundness of the toner mother particles can be adjusted by changing at least one of the above-described holding temperature and the period for maintaining the holding temperature. In order to inhibit elution of the toner core components or deformation of the toner cores, the above-described holding temperature is preferably lower than a glass transition point (Tg) of the toner cores. However, the above-described holding temperature may be set to be equal to or higher than the glass transition point (Tg) of the toner cores to cause deformation of the toner cores. As the above-described holding temperature increases, deformation of the toner cores tends to be promoted and the toner mother particles tend to have a shape close to a perfect sphere. The above-described holding temperature is preferably adjusted to achieve a desired shape of the toner mother particles. Further, when the shell materials are caused to react at a high temperature, the resultant shell layer tends to become hard. A molecular weight of the shell layer can also be controlled based on the above-described holding temperature.

After the shell layer is formed as described above, the dispersion of the toner mother particles is cooled for example to normal temperature (approximately 25° C.). Subsequently, the dispersion of the toner mother particles is filtered for example using a Buchner funnel. As a result, the toner mother particles are separated (solid-liquid separated) from the liquid and a wet cake of the toner mother particles is obtained. Subsequently, the resultant wet cake of the toner mother particles is washed. Subsequently, the washed toner mother particles are dried. Thereafter, the toner mother particles and an external additive may be mixed using a mixer (for example, an FM mixer produced by Nippon Coke & Engineering Co., Ltd.) as necessary to cause the external additive to adhere to surfaces of the toner mother particles. Note that in a situation in which a spray dryer is used in the drying process, the drying process and the external addition process can be performed simultaneously by spraying a dispersion of the external additive (for example, silica particles) to the toner mother particles. Through the above, a toner including a large number of toner particles is obtained.

Details and order of the processes in the above-described method for producing the toner may be altered as appropriate in accordance with desired structure or properties of the toner. For example, in a situation in which materials (for example, the shell materials) are caused to react in a liquid, the materials may be caused to react in the liquid for a specific period of time after addition of the materials to the liquid. Alternatively, the materials may be added to the liquid over a long period of time and caused to react in the liquid while being added to the liquid. Also, the shell materials may be added to the liquid as a single addition or may be divided up and added to the liquid as a plurality of additions. Further, the toner may be sifted after the external addition process. Non-essential processes may be omitted. For example, in a situation in which a commercially available product can be used directly as a material, use of the commercially available product can omit a process of preparing the material. In a situation in which reaction for forming the shell layer progresses favorably even without pH adjustment of the liquid, a process of pH adjustment may be omitted. If the external additive is unnecessary, the external addition process may be omitted. In a situation in which the external additive is not caused to adhere to the surfaces of the toner mother particles (the external addition process is omitted), the toner mother particles are equivalent to the toner particles. In synthesis of a resin, either of a monomer and a prepolymer may be used as a material for synthesizing the resin. In order to obtain a specific compound, a salt, ester, hydrate, or anhydride of the compound may be used as a raw material. Preferably, a large number of the toner particles are formed at the same time in order to produce the toner efficiently. Toner particles produced at the same time are thought to have substantially the same structure.

EXAMPLES

The following describes examples of the present invention. Table 1 shows toners TA-1 to TA-4, TB-1 to TB-7, TC-1 to TC-4, TD-1, and TD-2 (that are each a positively chargeable electrostatic latent image developing toner) according to examples and comparative examples. Further, Table 2 shows shell materials (suspensions A-1 to A-3 and B-1 to B-6 and aqueous solutions C-1 and C-2) used in production of the toners shown in Table 1. Note that "proportion" in Table 2 indicates a proportion (unit: mol %) of a specific repeating unit. Although a value for the proportion of a specific repeating unit shown in Table 2 is a calculation value, substantially the same value was obtained by measurement according to the GC/MS method.

TABLE 1

| | Shell material $S_A$ | | Shell material $S_B$ | | |
|---|---|---|---|---|---|
| Toner | Type | Amount [mL] | Type | Amount [mL] | Shape $S_A/S_B$ |
| TA-1 | A-1 | 20 | B-1 | 10 | Film/Particle |
| TA-2 | A-2 | | B-1 | | Film/Particle |
| TA-3 | A-3 | | B-1 | | Particle/Particle |
| TA-4 | C-1 | 10 | B-1 | 10 | Film/Particle |
| TB-1 | A-1 | 20 | B-2 | 10 | Film/Particle |
| TB-2 | A-1 | | B-3 | | Film/Particle |
| TB-3 | A-1 | | B-4 | | Film/Particle |

TABLE 1-continued

| | Shell material $S_A$ | | Shell material $S_B$ | | |
|---|---|---|---|---|---|
| Toner | Type | Amount [mL] | Type | Amount [mL] | Shape $S_A/S_B$ |
| TB-4 | A-1 | | B-5 | | Film/Particle |
| TB-5 | A-1 | | B-6 | | Film/Film |
| TB-6 | A-1 | | A-2 | | Film/Film |
| TB-7 | A-1 | | C-2 | | Film/Film |
| TC-1 | A-1 | 40 | B-1 | 10 | Film/Particle |
| TC-2 | A-1 | 10 | B-1 | | Film/Particle |
| TC-3 | A-1 | 20 | B-1 | 5 | Film/Particle |
| TC-4 | A-1 | 20 | B-1 | 20 | Film/Particle |
| TD-1 | A-1 | 20 | — | — | Film |
| TD-2 | — | — | B-1 | 10 | Particle |

TABLE 2

| Shell material | Property | Functional group (proportion) | Particle diameter [nm] | Tg [° C.] |
|---|---|---|---|---|
| A-1 | Hydrophobic | — | 31 | 71 |
| A-2 | | — | 98 | 68 |
| A-3 | | — | 27 | 104 |
| B-1 | Water-insoluble | Hydroxyl group (5 mol %) | 50 | 96 |
| B-2 | | Amino group (30 mol %) | 35 | 77 |
| B-3 | | Amide group (1.5 mol %) | 58 | 105 |
| B-4 | | Hydroxyl group (0.1 mol %) | 65 | 97 |
| B-5 | | Hydroxyl group (0.5 mol %) | 61 | 102 |
| B-6 | | Hydroxyl group (50 mol %) | 26 | 71 |
| C-1 | Water-soluble | — | — | — |
| C-2 | | Hydroxyl group (60 mol %) | — | 94 |

The following describes production methods, evaluation methods, and evaluation results of the toners TA-1 to TD-2 in order. In evaluations in which errors may occur, an evaluation value was calculated by calculating an arithmetic mean of an appropriate number of measured values to ensure that any errors were sufficiently small. A number average primary particle diameter was measured by taking an image of particles using a transmission electron microscope (TEM), unless otherwise stated. A volume median diameter ($D_{50}$) was measured using "Coulter Counter Multisizer 3" produced by Beckman Coulter, Inc., unless otherwise stated. A glass transition point (Tg) and a softening point (Tm) were measured according to respective methods described below, unless otherwise stated.

<Method for Measuring Tg>

A heat absorption curve of a sample (for example, a resin) was plotted using a differential scanning calorimeter ("DSC-6220" produced by Seiko Instruments Inc.). A glass transition point (Tg) of the sample was read from the plotted heat absorption curve. In the plotted heat absorption curve, a temperature at a point of change in specific heat (i.e., an intersection point of an extrapolation line of a base line and an extrapolation line of an inclined portion of the curve) corresponds to the glass transition point (Tg) of the sample.

<Method for Measuring Tm>

An S-shaped curve (horizontal axis: temperature, vertical axis: stroke) of a sample (for example, a resin) was plotted by setting the sample in a capillary rheometer ("CFT-500D" produced by Shimadzu Corporation) and causing melt-flow of 1 $cm^3$ of the sample under conditions of a die pore diameter of 1 mm, a plunger load of 20 $kg/cm^2$, and a heating rate of 6° C./minute. A softening point (Tm) of the sample was read from the plotted S-shaped curve. In the plotted S-shaped curve, a temperature at which the stroke value is "$(S_1+S_2)/2$", where $S_1$ represents a maximum stroke value and $S_2$ represents a base-line stroke value at low-temperature, corresponds to the softening point (Tm) of the sample.

[Production Method of Toner TA-1]

(Preparation of Toner Cores)

First, 750 g of a low viscosity polyester resin (Tg=38° C., Tm=65° C.), 100 g of a medium viscosity polyester resin (Tg=53° C., Tm=84° C.), 150 g of a high viscosity polyester resin (Tg=71° C., Tm=120° C.), 55 g of a carnauba wax ("Carnauba Wax No. 1" produced by S. Kato & Co.), and 40 g of a colorant ("KET BLUE 111" produced by DIC Corporation, Phthalocyanine Blue) were mixed using an FM mixer (product of Nippon Coke & Engineering Co., Ltd.) at a rotational speed of 2,400 rpm.

Then, the resultant mixture was melt-kneaded using a twin-screw extruder ("PCM-30" produced by Ikegai Corp.) under conditions of a material addition rate (material feeding rate) of 5 kg/hour, a shaft rotational speed of 160 rpm, and a temperature setting range (cylinder temperature) from 100° C. to 130° C. Thereafter, the resultant melt-kneaded product was cooled. The cooled melt-knead product was coarsely pulverized using a pulverizer ("ROTOPLEX (registered Japanese trademark) 16/8" produced by Hosokawa Micron Corporation). Then, the resultant coarsely pulverized product was finely pulverized using a jet mill ("Model-I Super Sonic Jet Mill" produced by Nippon Pneumatic Mfg. Co., Ltd.). The resultant finely pulverized product was classified using a classifier ("Elbow-Jet EJ-LABO" produced by Nittetsu Mining Co., Ltd.). As a result, toner cores having a volume median diameter ($D_{50}$) of 6 μm were obtained.

(Preparation of Shell Material $S_A$)

A 1-L three-necked flask equipped with a thermometer and a stirring impeller was set in a water bath and charged with 815 mL of ion exchanged water at a temperature of 30° C. and 75 mL of a cationic surfactant ("QUARTAMIN (registered Japanese trademark) 24P" produced by Kao Corporation, 25% by mass aqueous solution of lauryltrimethylammonium chloride). Then, a temperature inside the flask was increased to 80° C. using the water bath and the temperature (80° C.) was maintained. Subsequently, two liquids (a first liquid and a second liquid) were each dripped into the flask contents at the temperature of 80° C. over 5 hours. The first liquid was a liquid mixture of 68 mL of styrene and 12 mL of butyl acrylate. The second liquid was a solution obtained by dissolving 0.5 g of potassium peroxodisulfate in 30 mL of ion exchanged water. Subsequently, the temperature inside the flask was maintained at 80° C. for 2 hours to polymerize the flask contents. As a result, a suspension (hereinafter referred to as a suspension A-1) containing resin particulates (specifically, particles substantially formed from a hydrophobic thermoplastic resin that does not have physical cross-linking structure formed by hydrogen bonding) at a solid concentration of 8% by mass was obtained. The resin particulates contained in the resultant suspension A-1 had a number average primary particle diameter of 31 nm and Tg of 71° C.

(Preparation of Shell Material $S_B$)

A 1-L three-necked flask equipped with a thermometer and a stirring impeller was set in a water bath and charged with 790 mL of ion exchanged water at a temperature of 30° C. and 30 mL of a cationic surfactant ("QUARTAMIN 24P" produced by Kao Corporation, 25% by mass aqueous solution of lauryltrimethylammonium chloride). Then, a temperature inside the flask was increased to 80° C. using the water bath and the temperature (80° C.) was maintained. Subsequently, two liquids (a third liquid and a fourth liquid) were each dripped into the flask contents at the temperature of 80° C. over 5 hours. The third liquid was a liquid mixture of 120 mL of methyl methacrylate, 20 mL of butyl acrylate, and 10 mL of 4-hydroxybutyl acrylate. The fourth liquid was a solution obtained by dissolving 0.5 g of potassium peroxodisulfate in 30 mL of ion exchanged water. Subsequently, the temperature inside the flask was maintained at 80° C. for 2 hours to polymerize the flask contents. As a result, a suspension (hereinafter referred to as a suspension B-1) containing resin particulates (specifically, particles substantially formed from a water-insoluble thermoplastic resin having physical cross-linking structure formed by hydrogen bonding) at a solid concentration of 15% by mass was obtained. The resin particulates contained in the resultant suspension B-1 had a number average primary particle diameter of 50 nm and Tg of 96° C. A proportion of a specific repeating unit (repeating unit having a hydroxyl group) in the resin (resin particulates) contained in the suspension B-1 was 5 mol %.

(Shell Layer Formation Process)

A 1-L three-necked flask equipped with a thermometer and a stirring impeller was set in a water bath and charged with 300 mL of ion exchanged water. Then, a temperature inside the flask was maintained at 30° C. using the water bath. Subsequently, pH of the flask contents was adjusted to 7 using sodium hydroxide or a dilute hydrochloric acid. Subsequently, 20 mL of the shell material $S_A$ (suspension A-1 prepared as described above) and 10 mL of the shell material $S_B$ (suspension B-1 prepared as described above) were added into the flask, and the flask contents were sufficiently stirred. The hydrophobic resin particles and the water-insoluble resin particles were dispersed in the aqueous medium to obtain a dispersion of the shell materials.

Subsequently, 300 g of the toner cores (toner cores prepared as described above) were added into the flask, and the flask contents were stirred for 1 hour at a rotational speed of 200 rpm. Thereafter, 300 mL of ion exchanged water was added into the flask. Subsequently, a temperature inside the flask was increased to 70° C. at a rate of 1° C./minute while the flask contents were stirred at a rotational speed of 100 rpm. Subsequently, the flask contents were stirred for 2 hours at the temperature of 70° C. and the rotational speed of 100 rpm. Subsequently, the flask contents were cooled to normal temperature (approximately 25° C.), thereby obtaining a dispersion containing toner mother particles.

(Washing Process)

The resultant dispersion of the toner mother particles obtained as described above was filtered (solid-liquid separated) using a Buchner funnel to collect a wet cake of the toner mother particles. Thereafter, the resultant wet cake of the toner mother particles was re-dispersed in ion exchanged water. Further, dispersion and filtration were repeated five times to wash the toner mother particles.

(Drying Process)

Subsequently, the resultant toner mother particles were dispersed in 50% by mass aqueous solution of ethanol. As a result, a slurry of the toner mother particles was obtained. Subsequently, the toner mother particles in the slurry were dried using a continuous type surface modifier ("COATMIZER (registered Japanese trademark)" produced by Freund Corporation) under conditions of a hot air temperature of 45° C. and a blower flow rate of 2 $m^3$/minute. As a result, powder of the toner mother particles was obtained.

(External Addition Process)

Subsequently, external addition was performed on the resultant toner mother particles. Specifically, 100 parts by mass of the toner mother particles and 1.0 part by mass of dry silica particulates ("REA90" produced by Nippon Aerosil Co., Ltd.) were mixed for 5 minutes using a 10-L FM mixer (product of Nippon Coke & Engineering Co., Ltd.) to cause the external additive (silica particles) to adhere to surfaces of the toner mother particles. Thereafter, the resultant toner was sifted using a 200-mesh sieve (opening: 75 μm). As a result, a toner TA-1 including a large number of toner particles was obtained.

[Production Method of Toner TA-2]

A toner TA-2 was produced according to the same procedure as the production of the toner TA-1 in all aspects other than that 20 mL of a suspension A-2 was used instead of 20 mL of the suspension A-1.

(Preparation Method of Suspension A-2)

The suspension A-2 was prepared according to the same procedure as the preparation of the suspension A-1 in all aspects other than that the amount of the cationic surfactant (QUARTAMIN 24P) was changed from 75 mL to 25 mL. Resin particulates contained in the suspension A-2 had a number average primary particle diameter of 98 nm and Tg of 68° C.

[Production Method of Toner TA-3]

A toner TA-3 was produced according to the same procedure as the production of the toner TA-1 in all aspects other than that 20 mL of a suspension A-3 was used as the shell material $S_A$ instead of 20 mL of the suspension A-1.

(Preparation Method of Suspension A-3)

The suspension A-3 was prepared according to the same procedure as the preparation of the suspension A-1 in all aspects other than that the amount of styrene was changed from 68 mL to 80 mL and butyl acrylate was not used. Resin particulates contained in the suspension A-3 had a number average primary particle diameter of 27 nm and Tg of 104° C.

[Production Method of Toner TA-4]

A toner TA-4 was produced according to the same procedure as the production of the toner TA-1 in all aspects other than that 10 mL of an aqueous solution C-1 of sodium polystyrenesulfonate ("POLYNASS (registered Japanese trademark) PS-50" produced by Tosoh Corporation, solid concentration: 20% by mass) was used as the shell material $S_A$ instead of 20 mL of the suspension A-1.

[Production Method of Toner TB-1]

A toner TB-1 was produced according to the same procedure as the production of the toner TA-1 in all aspects other than that 10 mL of a suspension B-2 was used as the shell material $S_B$ instead of 10 mL of the suspension B-1.

(Preparation Method of Suspension B-2)

The suspension B-2 was prepared according to the same procedure as the preparation of the suspension B-1 in all aspects other than that a liquid mixture of 90 mL of methyl methacrylate and 60 mL of 2-(dimethylamino)ethyl methacrylate was used as the third liquid instead of the liquid mixture of 120 mL of methyl methacrylate, 20 mL of butyl acrylate, and 10 mL of 4-hydroxybutyl acrylate. Resin particulates contained in the suspension B-2 had a number average primary particle diameter of 35 nm and Tg of 77° C. A proportion of a specific repeating unit (repeating unit having an amino group) in the resin (resin particulates) contained in the suspension B-2 was 30 mol %.

[Production Method of Toner TB-2]

A toner TB-2 was produced according to the same procedure as the production of the toner TA-1 in all aspects other than that 10 mL of a suspension B-3 was used as the shell material $S_B$ instead of 10 mL of the suspension B-1.

(Preparation Method of Suspension B-3)

The suspension B-3 was prepared according to the same procedure as the preparation of the suspension B-1 in all aspects other than that a liquid mixture of 125 mL of methyl methacrylate, 23 mL of butyl acrylate, and 2 mL of N,N-dimethylacrylamide was used as the third liquid instead of the liquid mixture of 120 mL of methyl methacrylate, 20 mL of butyl acrylate, and 10 mL of 4-hydroxybutyl acrylate. Resin particulates contained in the suspension B-3 had a number average primary particle diameter of 58 nm and Tg of 105° C. A proportion of a specific repeating unit (repeating unit having an amide group) in the resin (resin particulates) contained in the suspension B-3 was 1.5 mol %.

[Production Method of Toner TB-3]

A toner TB-3 was produced according to the same procedure as the production of the toner TA-1 in all aspects other than that 10 mL of a suspension B-4 was used as the shell material $S_B$ instead of 10 mL of the suspension B-1.

(Preparation Method of Suspension B-4)

The suspension B-4 was prepared according to the same procedure as the preparation of the suspension B-1 in all aspects other than that a liquid mixture of 125 mL of methyl methacrylate, 25 mL of butyl acrylate, and 0.1 mL of 4-hydroxybutyl acrylate was used as the third liquid instead of the liquid mixture of 120 mL of methyl methacrylate, 20 mL of butyl acrylate, and 10 mL of 4-hydroxybutyl acrylate. Resin particulates contained in the suspension B-4 had a number average primary particle diameter of 65 nm and Tg of 97° C. A proportion of a specific repeating unit (repeating unit having a hydroxyl group) in the resin (resin particulates) contained in the suspension B-4 was 0.1 mol %.

[Production Method of Toner TB-4]

A toner TB-4 was produced according to the same procedure as the production of the toner TA-1 in all aspects other than that 10 mL of a suspension B-5 was used as the shell material $S_B$ instead of 10 mL of the suspension B-1.

(Preparation Method of Suspension B-5)

The suspension B-5 was prepared according to the same procedure as the preparation of the suspension B-1 in all aspects other than that a liquid mixture of 129 mL of methyl methacrylate, 20 mL of butyl acrylate, and 0.8 mL of 4-hydroxybutyl acrylate was used as the third liquid instead of the liquid mixture of 120 mL of methyl methacrylate, 20 mL of butyl acrylate, and 10 mL of 4-hydroxybutyl acrylate. Resin particulates contained in the suspension B-5 had a number average primary particle diameter of 61 nm and Tg of 102° C. A proportion of a specific repeating unit (repeating unit having a hydroxyl group) in the resin (resin particulates) contained in the suspension B-5 was 0.5 mol %.

[Production Method of Toner TB-5]

A toner TB-5 was produced according to the same procedure as the production of the toner TA-1 in all aspects other than that 10 mL of a suspension B-6 was used as the shell material $S_B$ instead of 10 mL of the suspension B-1.

(Preparation Method of Suspension B-6)

The suspension B-6 was prepared according to the same procedure as the preparation of the suspension B-1 in all aspects other than that a liquid mixture of 75 mL of methyl methacrylate and 75 mL of 3-hydroxypropyl methacrylate was used as the third liquid instead of the liquid mixture of 120 mL of methyl methacrylate, 20 mL of butyl acrylate, and 10 mL of 4-hydroxybutyl acrylate. Resin particulates contained in the suspension B-6 had a number average primary particle diameter of 26 nm and Tg of 71° C. A proportion of a specific repeating unit (repeating unit having a hydroxyl group) in the resin (resin particulates) contained in the suspension B-6 was 50 mol %.

[Production Method of Toner TB-6]

A toner TB-6 was produced according to the same procedure as the production of the toner TA-1 in all aspects other than that 10 mL of the suspension A-2 was used as the shell material $S_B$ instead of 10 mL of the suspension B-1.

[Production Method of Toner TB-7]

A toner TB-7 was produced according to the same procedure as the production of the toner TA-1 in all aspects other than that 10 mL of an aqueous solution C-2 of an acrylic acid-based resin was used as the shell material $S_B$ instead of 10 mL of the suspension B-1.

(Preparation Method of Aqueous Solution C-2 of Acrylic Acid-Based Resin)

The aqueous solution C-2 of an acrylic acid-based resin was prepared according to the same procedure as the preparation of the suspension B-1 in all aspects other than that a liquid mixture of 60 mL of methyl methacrylate and 90 mL of 2-hydroxyethyl methacrylate was used as the third liquid instead of the liquid mixture of 120 mL of methyl methacrylate, 20 mL of butyl acrylate, and 10 mL of 4-hydroxybutyl acrylate. A resin contained in the aqueous solution C-2 of an acrylic acid-based resin had Tg of 94° C. A proportion of a specific repeating unit (repeating unit having a hydroxyl group) in the resin contained in the aqueous solution C-2 of an acrylic acid-based resin was 60 mol %.

[Production Method of Toners TC-1 to TC-4]

Toners TC-1 to TC-4 were produced according to the same procedure as the production of the toner TA-1 in all aspects other than that the amounts of the shell material $S_A$ (suspension A-1) and the shell material $S_B$ (suspension B-1) used in the shell layer formation process were changed as shown in Table 1.

[Production Method of Toner TD-1]

A toner TD-1 was produced according to the same procedure as the production of the toner TA-1 in all aspects other than that the shell material $S_B$ (suspension B-1) was not used.

[Production Method of Toner TD-2]

A toner TD-2 was produced according to the same procedure as the production of the toner TA-1 in all aspects other than that the shell material $S_A$ (suspension A-1) was not used.

[Evaluation Methods]

Samples (toners TA-1 to TD-2) were each evaluated according to the following evaluation methods.

(High-Temperature Preservability)

First, 2 g of a sample (toner) was placed in a 20-mL polyethylene container and the container was left to stand for 3 hours in a thermostatic chamber set at a temperature of 60° C. Thereafter, the toner was taken out of the thermostatic chamber and cooled to obtain an evaluation toner.

The resultant evaluation toner was placed on a 100-mesh sieve (opening: 150 μm) having a known mass. A mass of the toner before sifting was calculated by measuring a total mass of the sieve and the evaluation toner thereon. Subsequently, the sieve was set in a powder tester (product of Hosokawa Micron Corporation) and the evaluation toner was sifted by shaking the sieve for 30 seconds at a rheostat level of 5 in accordance with a manual of the powder tester. After the sifting, a mass of toner remaining on the sieve was calculated by measuring a total mass of the sieve and the toner thereon. An agglomeration rate (unit: % by mass) was calculated from the mass of the toner before the sifting and the mass of the toner after the sifting (mass of the toner remaining on the sieve after the sifting) in accordance with the following equation.

$$\text{Agglomeration rate} = 100 \times (\text{mass of toner after sifting})/(\text{mass of toner before sifting})$$

An agglomeration rate of not greater than 50% by mass was evaluated as good. An agglomeration rate of greater than 50% by mass was evaluated as poor.

(Low-Temperature Fixability)

A two-component developer was prepared by mixing 100 parts by mass of a developer carrier (carrier for "TASKalfa5550ci" produced by KYOCERA Document Solutions Inc.) and 10 parts by mass of a sample (toner) for 30 minutes using a ball mill.

Low-temperature fixability was evaluated by forming an image using the two-component developer prepared as described above. A color printer ("FS-05250DN" produced by KYOCERA Document Solutions Inc., modified so as to be capable of changing a fixing temperature for use as an evaluation apparatus) equipped with a roller-roller type heat and pressure fixing device was used as the evaluation apparatus. The two-component developer prepared as described above was loaded into a developing device of the evaluation apparatus and a sample (toner for replenishment use) was loaded into a toner container of the evaluation apparatus.

In evaluation of low-temperature fixability of the sample (toner), a solid image having a size of 25 mm×25 mm was formed on paper of 90 g/m$^2$ (plain paper of A4 size) using the evaluation apparatus under conditions of a linear velocity of 200 mm/second and a toner application amount of 1.0 mg/cm$^2$ in an environment at a temperature of 23° C. and a relative humidity of 60%. Subsequently, the paper on which the image was formed was passed through the fixing device of the evaluation apparatus. The fixing temperature was set within a range from 100° C. to 200° C. Specifically, a lowest temperature (lowest fixing temperature) at which the solid image (toner image) was fixable to the paper was measured by gradually increasing the fixing temperature of the fixing device from 100° C.

In measurement of the lowest fixing temperature, whether or not the solid image (toner image) was fixable was determined by a fold-rubbing test described below. Specifically, the paper was folded such that a surface on which the image was formed was folded inwards, and a 1-kg weight covered with cloth was rubbed back and forth on the fold five times. Subsequently, the paper was unfolded and the folded portion (portion at which the solid image was formed) was observed. A length of toner peeling of the folded portion (peeling length) was measured. The lowest temperature among fixing temperatures for which the peeling length was not greater than 1 mm was determined to be the lowest fixing temperature.

A lowest fixing temperature not higher than 150° C. was evaluated as good, and a lowest fixing temperature higher than 150° C. was evaluated as poor.

[Evaluation Results]

Table 3 shows evaluation results (high-temperature preservability: agglomeration rate, low-temperature fixability: lowest fixing temperature) for each of the toners TA-1 to TD-2.

TABLE 3

| | Toner | High-temperature preservability [% by mass] | Low-temperature fixability [° C.] |
|---|---|---|---|
| Example 1 | TA-1 | 33 | 142 |
| Example 2 | TA-2 | 41 | 140 |
| Example 3 | TA-3 | 20 | 150 |
| Example 4 | TB-1 | 44 | 141 |
| Example 5 | TB-2 | 28 | 142 |
| Example 6 | TB-4 | 50 | 140 |
| Example 7 | TB-5 | 48 | 142 |
| Example 8 | TC-1 | 22 | 148 |
| Example 9 | TC-2 | 42 | 142 |
| Example 10 | TC-3 | 44 | 141 |
| Example 11 | TC-4 | 26 | 143 |
| Comparative example 1 | TA-4 | 68 (poor) | 144 |
| Comparative example 2 | TB-3 | 55 (poor) | 140 |
| Comparative example 3 | TB-6 | 52 (poor) | 140 |
| Comparative example 4 | TB-7 | 48 | 152 (poor) |
| Comparative example 5 | TD-1 | 66 (poor) | 140 |
| Comparative example 6 | TD-2 | 73 (poor) | 135 |

The toners TA-1 to TA-3, TB-1, TB-2, TB-4, TB-5, and TC-1 to TC-4 (toners according to Examples 1 to 11) each had the above-described basic features. Specifically, as shown in Tables 1 and 2, in each of the toners according to Examples 1 to 11, the shell layer included a plurality of first domains and a second domain present among the plurality of first domains. The plurality of first domains were each substantially formed from a first thermoplastic resin (specifically, a water-insoluble thermoplastic resin having physical cross-linking structure formed by hydrogen bonding). The second domain was substantially formed from a second thermoplastic resin (specifically, a hydrophobic thermoplastic resin that does not have physical cross-linking structure formed by hydrogen bonding) that was more hydrophobic than the second thermoplastic resin. Also, the first thermoplastic resin included a specific repeating unit (a repeating unit having at least one group selected from the group consisting of a hydroxyl group, an amino group, and an amide group). Further, a proportion of the specific repeating unit among all repeating units included in the first thermoplastic resin was at least 0.5 mol % and no greater than 50 mol % (see Table 2).

Through observation of surfaces of toner particles using a scanning electron microscope (SEM), it was found that resin particles contained in the shell material $S_A$ and resin particles contained in the shell material $S_B$ each had a shape as indicated in "Shape" in Table 1 after the shell layer formation process. In each of the toners TA-1, TA-2, TB-1, TB-2, TB-4, and TC-1 to TC-4, the shell layer had sea-and-island structure in which the plurality of first domains were distributed like islands and the second domain was distributed like a sea. Specifically, at least one first domain and at least a part of the second domain were exposed at a surface of the shell layer. Each of the plurality of first domains was a particle (see "Shape" in Table 1) substantially formed from the first thermoplastic resin. The second domain was a film (see "Shape" in Table 1) substantially formed form the second thermoplastic resin. In the shell layer formation process, by deformation of resin particles contained in the shell material $S_A$ (suspension A-1 in the case of the toner TA-1) into a film, the second domain having a thickness of about a half of a particle diameter (see Table 2) of the resin particles contained in the shell material $S_A$ was formed. The first domains had a number average primary particle diameter that was the same as a particle diameter (see Table 2) of resin particles contained in the shell material $S_B$ (suspension B-1 in the case of the toner TA-1). In each of the toners TA-1, TA-2, TB-1, TB-2, TB-4, and TC-1 to TC-4, the first domains had a number average primary particle diameter of at least 20 nm and no greater than 70 nm, and the second domain had a thickness of at least 10 nm and no greater than 60 nm.

As shown in Table 3, each of the toners according to Examples 1 to 11 was excellent in both high-temperature preservability and low-temperature fixability. Further, in each of the toners according to Examples 1 to 11, an amount of free formaldehyde and an amount of free isocyanate were small.

INDUSTRIAL APPLICABILITY

The electrostatic latent image developing toner according to the present invention can be used for image formation for example in a copier, a printer, or a multifunction peripheral.

The invention claimed is:

1. An electrostatic latent image developing toner comprising a plurality of toner particles each including a core and a shell layer disposed over a surface of the core, wherein the shell layer includes a plurality of first domains and a second domain that is present at least among the plurality of first domains, the plurality of first domains are each substantially formed from a first thermoplastic resin, the second domain is substantially formed from a second thermoplastic resin that is more hydrophobic than the first thermoplastic resin, the first thermoplastic resin includes at least one specific repeating unit having at least one group selected from the group consisting of a hydroxyl group, an amino group, and an amide group, and a proportion of the at least one specific repeating unit among all repeating units included in the first thermoplastic resin is at least 0.5 mol % and no greater than 50 mol %.

2. The electrostatic latent image developing toner according to claim 1, wherein the shell layer has sea-and-island structure in which the plurality of first domains are distributed like islands and the second domain is distributed like a sea, each of the plurality of first domains is a particle substantially formed from the first thermoplastic resin, and the second domain is a film substantially formed from the second thermoplastic resin.

3. The electrostatic latent image developing toner according to claim 2, wherein the plurality of first domains have a number average primary particle diameter of at least 20 nm and no greater than 70 nm, and the second domain has a thickness of at least 10 nm and no greater than 60 nm.

4. The electrostatic latent image developing toner according to claim 3, wherein the first thermoplastic resin has a higher glass transition point than the second thermoplastic resin, and the glass transition point of the first thermoplastic resin is at least 75° C. and no greater than 120° C.

5. The electrostatic latent image developing toner according to claim 1, wherein a proportion of a thermosetting resin formed by polymerization reaction of formaldehyde or isocyanate among all resins forming the shell layer is not greater than 5% by mass.

6. The electrostatic latent image developing toner according to claim 1, wherein the first thermoplastic resin includes as the at least one specific repeating unit, at least one repeating unit selected from the group consisting of: a repeating unit derived from a (meth)acrylic acid hydroxyalkyl ester; a repeating unit derived from a (meth)acrylic acid alkylaminoalkyl ester; and a repeating unit derived from an alkylacrylamide.

7. The electrostatic latent image developing toner according to claim 1, wherein the first thermoplastic resin and the second thermoplastic resin each include at least one repeating unit derived from an acrylic acid-based monomer.

8. The electrostatic latent image developing toner according to claim 7, wherein the first thermoplastic resin is a polymer of at least two acrylic acid-based monomers including at least one acrylic acid-based monomer selected from the group consisting of a (meth)acrylic acid hydroxyalkyl ester, a (meth)acrylic acid alkylaminoalkyl ester, and an alkylacrylamide.

9. The electrostatic latent image developing toner according to claim 7, the second thermoplastic resin is a copolymer of at least one styrene-based monomer and at least one acrylic acid-based monomer.

10. The electrostatic latent image developing toner according to claim 1, wherein the first thermoplastic resin is a water-insoluble thermoplastic resin having physical cross-linking structure formed by hydrogen bonding, and the second thermoplastic resin is a hydrophobic thermoplastic resin that does not have physical cross-linking structure formed by hydrogen bonding.

* * * * *